United States Patent [19]

Kasai et al.

[11] 4,300,345

[45] Nov. 17, 1981

[54] METHOD FOR WINDING A FALSE TWISTED YARN IN A CHEESE

[75] Inventors: Isamu Kasai, Oomihachiman; Kazuo Tomiita; Hisao Inuyama, both of Ootsu, all of Japan

[73] Assignee: Toray Industries, Inc., Tokyo, Japan

[21] Appl. No.: 93,628

[22] Filed: Nov. 13, 1979

[30] Foreign Application Priority Data

Nov. 27, 1978 [JP] Japan ..... 53-145291

[51] Int. Cl.[3] ..... D02G 1/02

[52] U.S. Cl. ..... 57/290; 57/284; 57/288; 242/18 R

[58] Field of Search ..... 57/284, 286, 290, 287, 57/288, 62; 242/18 R, 18 DD, 159

[56] References Cited

U.S. PATENT DOCUMENTS

| | | | |
|---|---|---|---|
| 3,091,912 | 6/1963 | Stoddard et al. | 57/290 X |
| 3,422,617 | 1/1969 | Dudzik et al. | 57/284 |
| 3,462,933 | 8/1969 | Nava | 57/290 |
| 3,831,362 | 8/1974 | Dudzik | 57/284 |
| 3,987,611 | 10/1976 | Kitamura et al. | 57/284 |

*Primary Examiner*—John Petrakes

*Attorney, Agent, or Firm*—Austin R. Miller

[57] ABSTRACT

A method for soft winding around a bobbin a false twisted yarn, which is delivered from a false twisting zone wherein false twists imparted into a fed yarn and running back therealong are heat set and which is heat treated by a second heater, the false twisted yarn being fed by means of a yarn delivery means to the bobbin in a winding apparatus. The time period wherein the false twisted yarn travels from the yarn delivery means to the bobbin is adjusted at a special value so that a soft wound cheese having a uniform and low apparent density and good shape can be obtained.

16 Claims, 4 Drawing Figures

TIME PERIOD S (sec)
0.6
0.4
0.2
0
C
A
B
S = 15/V
S = 5/6 x 10^5 / V^2
333.3
666.7
1000
1333.3
1666.7
PERIPHERAL SPEED OF DELIVERY MEANS (m/min)

1
Y
21
2'
2
3
Vy m/min
4
5'
5
Wy
Mf %
6
T °C
VB m/min
7
7'
By
P
11
12
Vt m/min
Vd m/min
9
10
Wf %

METHOD FOR WINDING A FALSE TWISTED YARN IN A CHEESE

BRIEF DESCRIPTION OF THE INVENTION

The present invention relates to a method for winding a false twisted yarn on a bobbin to form a cheese. More specifically, the present invention relates to a method by which a false twisted yarn is delivered at a stable running condition and soft wound at a high efficiency on a bobbin to form a straight cheese having a uniform apparent density and a good wound shape and which is free from disadvantages which are unavoidable with conventionally known methods for winding a false twisted yarn on a bobbin to form a cheese.

BACKGROUND OF THE INVENTION

Conventionally known and industrially applicable is a method for winding a false twisted yarn in a false twisting texturing machine wherein the false twisted yarn delivered from a delivery roller is generally wound on a bobbin after it passes by a guide fixedly secured at a position of the fulcrum for traverse motion of a winding apparatus or after it passes by a bar guide disposed between the delivery roller and the winding apparatus along the axis of the bobbin and having an engaging surface over which the yarn wraps around and over which the yarn slides along the lengthwise direction. According to such a conventional method, the above-mentioned fixed guide and bar guide may be harmful to a stable soft winding of the false twisted yarn into a cheese. More specifically, when the false twisted yarn is wound into a cheese, especially a soft cheese having an apparent density of equal to or less than 0.3 g/cm$^3$, the yarn may be slacked because of the friction with the fixed or bar guide, and accordingly tension fluctuation in the yarn may occur. As a result, it becomes very difficult to stably wind a false twisted yarn, and the apparent density of the thus obtained cheese is not uniform, and furthermore the shape of the obtained cheese becomes bad. In addition, it should be noted that the differences in the size and the surface condition of the fixed or bar guide affect the influence regarding the apparent density and the wound shape of the cheese, and therefore the changes in the size and the surface condition of the fixed or bar guide as the operating time period lapses affects a serious influence to the apparent density and the wound shape of the cheese.

The inventors of the present invention effected various surveys concerning the causes of the defects, i.e., the non-uniformity of the apparent density of a cheese and the undesirable shape of the cheese. As a result, they found that the defects appear more often as the yarn winding speed, the winding feed ratio or the time period which it takes for the false twisted yarn to travel from the yarn delivery means disposed nearest the winding apparatus to the bobbin rotatably supported in the winding apparatus is increased. However, in a conventional winding method, any attempt to obviate such defects has not been carried out because the results obtained by the inventors' surveys have not been understood completely.

In addition, a conventional soft wound cheese which is wound on a bobbin successively after the false twisting operation in a false twisting texturing machine has a disadvantage. The disadvantage is in that, when the obtained soft wound cheese is subjected to a conventionally known steam set or dyeing operation while it is in a soft wound cheese and then it is rewound to form a cone of a heat treated or dyed yarn, the heat treated or dyed yarn thus obtained suffers from uneveness in crimp characteristics and dyeability in accordance with the locations of the yarn in the cheese. The uneveness can be observed, for example, between the yarns at the innermost portion, intermediate portion or the outermost portion with respect to the radial direction of the cheese, or between the yarns at the end portion or the central portion with respect to the axial direction of the cheese. The main cause of the disadvantage exists in the fact that the apparent density in a soft wound cheese obtained according to a conventionally known method varies in accordance to the location in the cheese. Another cause of the disadvantage is in the fact that the apparent density in a soft wound cheese is not entirely uniform but varies locally. Such a variation in apparent density is caused by the changes in winding conditions, such as the tension in the yarn, which causes the bulges on the lateral end surface of the cheese. In other words, a soft wound cheese with a bad shape, i.e., a bulged cheese, does not have a uniform apparent density, and therefore, it has a tendency that the heat treated or dyed yarn obtained therefrom in accordance with package steam setting or dyeing may suffer from the deterioration of its crimp characteristics and dyeability.

Also considered to be a cause of the above-mentioned disadvantage is the non-uniformity of the shrinkage of the false twisted yarn which is subjected to a heat treatment as a soft wound cheese. More specifically, the yarn at the innermost portion in the cheese is not permitted to shrink freely because its shrinkage is suppressed by the bobbin, and in addition it is elongated because it receives a compressive force caused by the shrinking force of the yarn located around the outermost portion. On the other hand, the yarn located at the outermost portion in the cheese slightly slacks. As a result, differences in the heat shrinkage and the apparent density between the locations are created, and the above-mentioned disadvantage occurs.

U.S. Pat. No. 3,987,611 discloses a method for winding a textured yarn, wherein a specially designed complicated speed converter for controlling a winding feed is applied in order to obtain a yarn with uniform stretch properties. However, since such a converter is complicated, a method which utilizes a simple device and by which a yarn is effectively soft wound has been desired.

SUMMARY OF THE INVENTION

An object of the present invention is to provide an improved and effective method for winding a false twisted yarn on a bobbin to form a soft wound cheese, having a uniform apparent density and good wound shape, which is used in a dyeing operation and which is free from the above-mentioned disadvantages.

The object of the present invention is achieved by a method of cheese winding around a bobbin a false twisted yarn which is delivered at a speed of V cm/sec from a false twisting region, wherein false twists imparted into a fed yarn and running back therealong are heat set by means of a yarn delivery means to the bobbin rotatably supported in a winding apparatus where the false twisted yarn is traversed to and fro along the bobbin to form a cheese thereon. The method is characterized in that the time period S sec wherein the false twisted yarn travels from the yarn delivery means to the bobbin satisfies the following equation (1), $$\alpha/V \leqq S \leqq \beta/V^2 \quad (1)$$

wherein $\alpha$ is 15

$\beta$ is $(5/6)\times 10^5$ whereby a soft wound straight cheese with an apparent density equal to or less than 0.3 g/cm$^3$ is obtained.

The present invention can be carried out for winding a false twisted yarn which is not subjected to a second heat treatment, i.e., a woolly type textured yarn, as well as a false twisted yarn which is successively subjected to a second heat treatment, i.e., a modified textured yarn.

In the case wherein a modified textured yarn which is stabilized in its thermal crimp characteristics is wound, there is proposed another aspect of the present invention wherein the fed yarn is false twisted in the false twisting region at a speed of $V_y$ m/min, and the obtained false twisted yarn is overfed under a second feed ratio of $M_f$% in the second heat treating region which is provided with a second heater heated at a temperature T° C., and then the modified false twisted yarn is traversed to and fro at a traversing speed of $V_t$ m/min and wound on the bobbin at a winding feed ratio of $W_f$%. The method in this aspect is characterized in that the winding feed ratio $W_f$% satisfies the following equation (2).

$$M_f + \left(\frac{T}{20} - 14\right) + \left(\frac{\sqrt{v_y^2 + v_t^2} - v_y}{v_y} \times 100\right) \leqq W_f \leqq M_f + \left(12 - \frac{T}{20}\right) + \frac{\sqrt{v_y^2 + v_t^2} - v_y}{v_y} \times 100\Bigg) \quad (2)$$

BRIEF DESCRIPTION OF THE ACCOMPANYING DRAWINGS

Some embodiments of the present invention will now be explained with reference to the accompanying drawings, wherein.

DETAILED DESCRIPTION OF THE INVENTION

Figure 1:
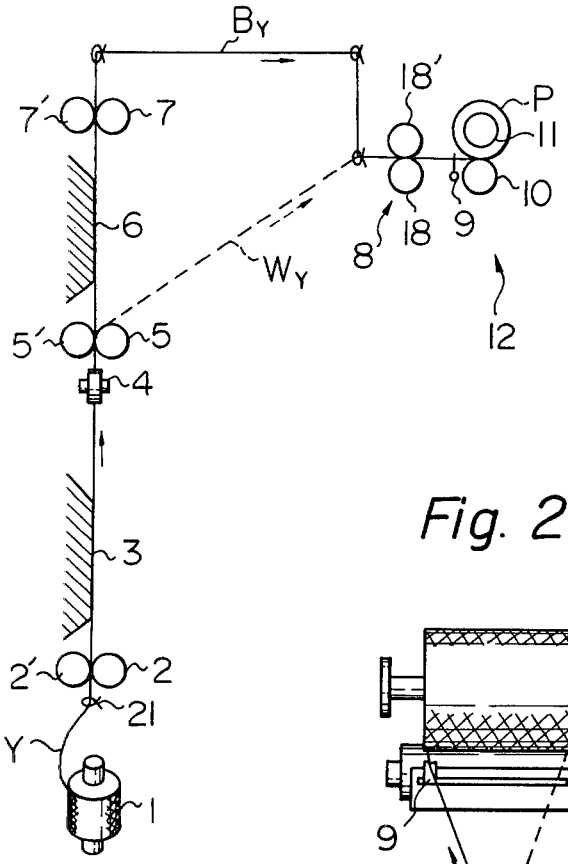
FIG. 1 is a diagrammatical elevational view of a machine wherein the present invention is carried out.

Referring to FIG. 1, according to the present invention a yarn Y is withdrawn from a supply package 1 by means of a pair of first rollers 2 and 2′ via a yarn guide 21 and then is delivered to a pair of second rollers 5 and 5′. Between the first and second rollers 2 and 2′, and 5 and 5′, the fed yarn Y is subjected to a false twisting operation by means of a false twisting apparatus 4 for imparting false twists to the yarn Y and a first heater 3 for heat setting the false twists running back along the yarn Y, and a woolly type textured yarn $W_y$ is obtained. The obtained woolly type textured yarn $W_y$ is then subjected to another heat treatment between the second rollers 5 and 5′ and a pair of third rollers 7 and 7′ by means of a second heater 6, and accordingly a modified false twisted textured yarn $B_y$ is obtained. The woolly type textured yarn $W_y$ or the modified false twisted textured yarn $B_y$ is then delivered at a speed of v cm/sec from a yarn delivery means 8, which consists of a pair of delivery rollers 18 and 18′ in this embodiment, leading to a winding apparatus 12 which comprises a traverse guide 9 for traversing the yarn $W_y$ or the yarn $B_y$ to and fro in a direction transverse to the yarn passage, a drive roller 10 and a bobbin 11 disposed rotatably and driven by the drive roller 10 so that a soft straight cheese P is formed on the bobbin 11. The present invention is characterized in that the time period S sec wherein the woolly type textured yarn $W_y$ or the modified false twisted textured yarn $B_y$ travels from the yarn delivery means 8 to the bobbin 11 in the winding apparatus is so selected that it is in a range between 15 /V and $(5/6)\times 10^5$ /V$^2$.

The supply yarn Y utilized in the present invention is a yarn composed of thermoplastic synthetic filaments, such as a polyester or a polyamide filament. The supply yarn of a thermoplastic synthetic multifilament yarn may be a fully drawn yarn, and in this case the yarn is only false twisted. In other words, the supply yarn of a thermoplastic synthetic multifilament yarn may be a highly orientated undrawn yarn, i.e., a partially orientated yarn often abridged as POY, or an undrawn yarn. In these cases, the supply yarn Y is subjected to a drawing operation: (1) between the first rollers 2 and 2′ and the second rollers 5 and 5′ simultaneous with the false twisting operation; or (2) between the yarn guide 21 and the first rollers 2 and 2′ utilizing another pair of feed rollers (not shown) and the false twisting operation takes place sequential to the drawing operation.

The false twisting machine may be: (1) a double heater type as illustrated in FIG. 1 which can produce the modified false twisted yarn; or (2) a single heater type (not shown) which can produce a woolly type false twisted textured yarn. If the double heater type false twisting machine illustrated in FIG. 1 is used for producing a woolly type false twisted textured yarn, the woolly type false twisted yarn $W_y$ is directly delivered from the second rollers 5 and 5′ to the delivery means 8 as illustrated by a broken line in FIG. 1.

The false twisting apparatus 4 may be: a false twisting spindle type; an inner friction type, such as a rotatable cylinder provided with one or more false twisting bushes; an outer friction type, such as a plurality of friction disks disposed on three shafts; or an air jet type. However, the type of the false twisting machine and the type of the false twisting apparatus are not limited.

The obtained textured yarn may be a woolly type false twisted textured yarn or a modified false twisted textured yarn. To effectively carry out the method of the present invention, a modified false twisted textured yarn wherein the crimp and strain generated in woolly type false twisted textured yarn are fully stabilized is more preferable than the woolly type false twisted textured yarn, and the soft cheese obtained thereby has a more uniform apparent density and a better wound shape.

Figure 3:
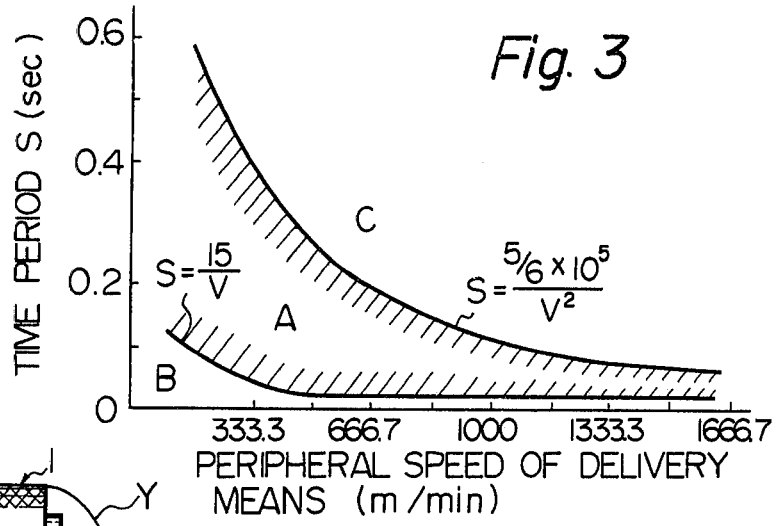
FIG. 3 is a diagram which illustrates the relationship between the time period and speed of the delivery means.

FIG. 3 is a diagram which illustrates the relationship between the time period S sec and the yarn delivering speed v cm/sec of the delivery means which positively delivers the yarn and which is located just upstream of the winding apparatus. According to the present invention, the time period S sec is required to satisfy the following equation.

$$15/V \leqq S \leqq 5/6 \times 10^5/V^2$$

The left term 15 /V is decided based on the minimum distance between the yarn delivery means and the bobbin in the winding apparatus. In the region B wherein the time period S is smaller than 15 /V, the distance between the yarn delivery means and the bobbin in the winding apparatus is smaller than 15 cm. Under such a condition, the yarn which is traversed to and fro and then wound on the bobbin is exposed to considerable changes in the yarn tension caused by the traverse motion. As a result, the apparent density in the cheese thus obtained has a large difference between that at the central portion and that at the end portion, and the wound shape of the cheese becomes inferior.

The right term $5/6 \times 10^5/V^2$ is decided based on the physical phenomenon, i.e. air resistance which is proportional to the square of the yarn delivering speed. In the region C wherein the time period S sec is larger than $5/6 \times 10^5/V^2$, the time period wherein the yarn is delivered from the yarn delivery means to the bobbin in the yarn winding apparatus is too long so that the yarn is affected by influences caused by the weight of itself, ambient atmosphere and the resistance caused by the wake flow, and accordingly yarn fluctuation and slack occur. As a result, removal of the yarn from the traverse guide and the yarn entanglement around the yarn delivery means are caused, and it becomes difficult to complete the winding of the soft cheese.

In the region A wherein the requirement of the present invention can be satisfied, the damages caused by the traverse motion and the air resistance can be minimized, and accordingly the stability of the yarn delivery is increased and maintained, and the soft wound cheese thus obtained has an apparent uniform density and a superior shape.

Figure 2:
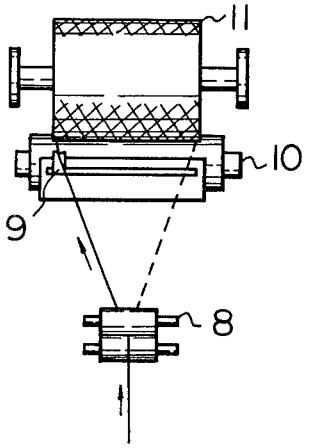
FIG. 2 is an enlarged plan view wherein a part of the machine illustrated in FIG. 1 is illustrated.

When the method of the present invention is carried out, the yarn delivery means 8 may be located at a position substantially being a fulcrum of the traverse motion, and substantially no yarn guide is disposed between the yarn delivery means 8 and the bobbin 11 in the winding apparatus as illustrated in FIG. 2. According to this construction, the influence of the yarn guide does not affect adversely the yarn, and a cheese is wound stably because the yarn is delivered stably.

Figure 4:
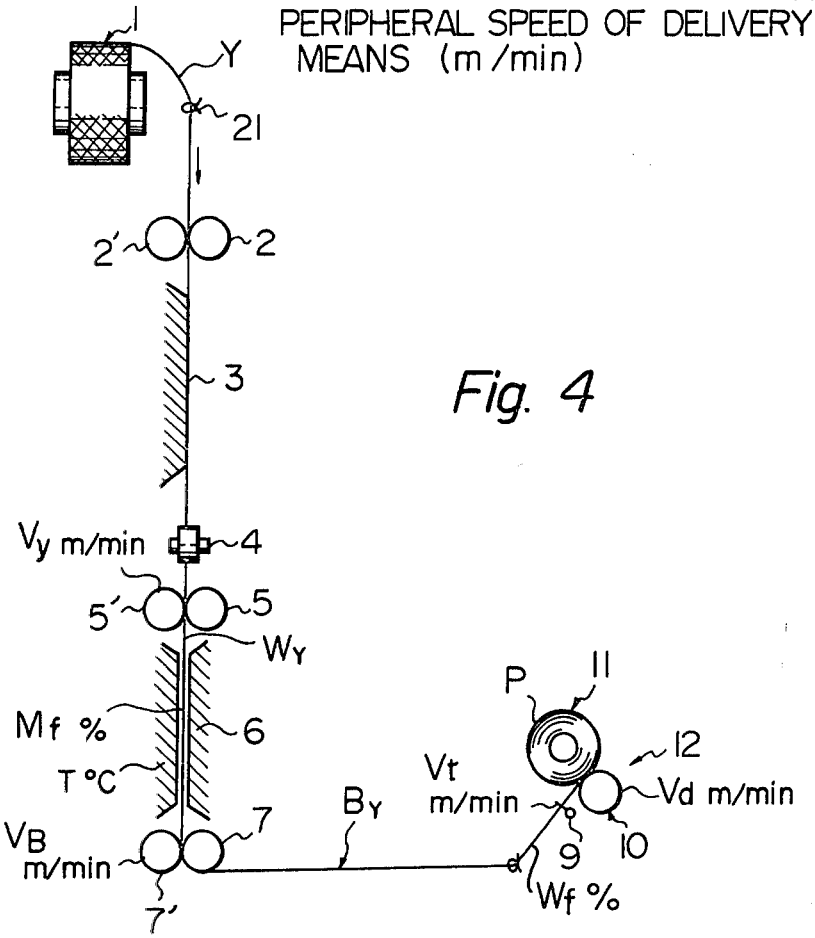
FIG. 4 is a diagrammatical elevational view of another embodiment of the present invention.

It is preferable that the yarn delivery means 8 is constructed with a pair of nip rollers 18 and 18' as illustrated in FIG. 1. However, the yarn delivery means may be any type of positive yarn delivering mechanism, such as Nelson type rollers or an aspirator. In some cases, the delivery means may be a non-positive yarn delivery mechanism, such as a rotatable frictional engaging member. When a woolly type false twisted textured yarn $W_y$ (FIG. 1) is wound on a bobbin, the second rollers 5 and 5' (FIG. 1) may be also used as a yarn delivery means. When a modified false twisted textured yarn $B_y$ (FIG. 1) is wound on a bobbin, the third rollers 7 and 7' may be also used as a yarn delivery means 8 as illustrated in FIG. 4.

It is very important for effectively carrying out the present invention in order to obtain a soft wound cheese that the contacting pressure between the bobbin 11 and the drive roller 10 (FIGS. 1 and 2) is selected appropriately. The desirable contacting pressure varies in accordance with the material of the yarn, fineness of the filaments which constitute the yarn, the total denier of the yarn and the traverse stroke. The inventors of the present invention confirmed, based on their experiences, that if the traverse stroke was equal to or less than 30 cm, it was preferable that the contacting pressure in the initial stage of the winding operation, i.e., upon the commencement of the winding operation, is between 0.3 kg and 5 kg, and that the contacting pressure upon the completion of the winding operation is between 0.5 kg and 6 kg. If the contacting pressure upon the commencement of the winding operation is less than 0.3 kg, slip between the drive roller 10 and the bobbin 11 occurs and the rotation of the drive roller is not transmitted to the bobbin 11. On the other hand, if the contacting pressure upon the completion of the winding operation is higher than 6 kg, the soft wound cheese which has been wound on the bobbin may be crushed by the contacting pressure, and accordingly soft winding of the false twisted textured yarn cannot be achieved.

The method of the present invention can achieve splendid advantages, especially in the soft winding of a yarn, having a low tension and being false twisted at a speed equal to or higher than 300 m/min, in order to form a cheese having an apparent density equal to or less than 0.3 g/cm$^3$ or in soft winding of a yarn which has a low crimp therein.

As mentioned above, to effectively carry out the method of the present invention, a modified false twisted textured yarn wherein the crimp and strain created in a woolly type false twisted textured yarn and fully stabilized is more preferable than the woolly type false twisted textured yarn, and the soft cheese obtained thereby has a more uniform apparent density and a better wound shape.

A method which is preferable and effective to obtain a soft wound cheese of the modified false twisted textured yarn will be explained hereinbelow with reference to FIG. 4. A yarn Y is withdrawn from a supply package 1 by means of a pair of first rollers 2 and 2' via a yarn guide 21 and then is delivered to a pair of second rollers 5 and 5', the peripheral speed of which is $V_y$ m/min. Between the first and second rollers 2 and 2', and 5 and 5', the fed yarn Y is subjected to a false twisting operation at a speed of $v_y$ m/min by means of a false twisting apparatus 4 and a first heater 3. The woolly type false twisted textured yarn $W_y$ thus obtained is successively subjected to a second heat treatment between the second rollers 5 and 5' and a pair of third rollers 7 and 7', the peripheral speed of which is $v_B$ m/min, under a certain second feed ratio $M_f$ % by means of a second heater 6 which is maintained at a temperature T°C. so that the woolly type false twisted textured yarn $W_y$ is sufficiently heat shrunk and so that the crimp therein is heat set, and as a result a modified false twisted textured yarn $B_y$ is obtained. When the modified false twisted textured yarn $B_y$ is wound on a bobbin 11 by means of a winding apparatus 12 wherein the contacting pressure between the bobbin 11 and a drive roller 10 upon the commencement of the winding operation is between 0.3 kg and 5 kg and a yarn traverse guide 9 is traversed to and fro at a speed $v_t$ m/min, the peripheral speed $v_d$ m/min of the drive roller 10 is adjusted so that the winding feed ratio $W_f$ % can satisfy the equation (2).

$$M_f + \left(\frac{T}{20} - 14\right) + \left(\frac{\sqrt{v_y^2 + v_t^2} - v_y}{v_y} \times 100\right) \leqq W_f \leqq \quad (2)$$

-continued $$M_f + \left(12 - \frac{T}{20}\right) + \left(\frac{\sqrt{v_y^2 + v_t^2} - v_y}{v_y} \times 100\right)$$

Note that the above-mentioned feed ratios $M_f$ and $W_f$ are defined as follows.

Second feed ratio $M_f\% = 100 \times (v_y - v_B)/v_y\ \%$

Winding feed ratio $W_f\% = 100 \times (v_y - v_d)/v_y\ \%$

The meaning of the equation (2) is that the winding feed ratio $W_f$ % under the false twisting speed $V_y$ m/min has a linear relationship with the second feed ratio $M_f$%, the temperature T°C. of the second heater and the traverse speed $v_t$ m/min. More specifically the left term of the equation (2) defines the critical condition to obtain a soft wound cheese having an apparent density equal to or less than 0.3 g/cm$^3$. The right term of the equation (2) defines the critical condition for relaxing the modified false twisted textured yarn.

The desirable range of the conditional elements utilized in equation (2) will be explained hereinbelow.

The second feed ratio $M_f$ contributes to the relaxing condition of the woolly type false twisted textured yarn in the second heater, and accordingly, permits the woolly type false twisted textured yarn to heat shrink sufficiently, and it is desirable that the second feed ratio $M_f$% is equal to or larger than +5% but does not exceed the shrinking limit. Note that the sign "+" means that the yarn is overfed.

It is desirable that the temperature T°C. of the second heater is adjusted to be higher than the temperature at which the obtained yarn is subjected to the heat treatment, such as during a steam set or dyeing operation in the succeeding steps, but to be not higher than the thermoplastifying temperature of the yarn, so that the woolly type false twisted textured yarn which is relaxed under the second feed ratio $M_f$% is fully heat shrunk and heat set and so that the heat shrinkage substantially does not take place while the obtained yarn is subjected to the heat treatment in the succeeding steps.

The traversing speed $v_t$ has a relationship with a winding angle in the soft wound cheese. It is desirable that the ratio $v_t/v_y$ of the traversing speed $v_t$ m/min against the false twisting texturing speed $v_y$ m/min is in a range between 0.1 and 0.3. If the traversing speed $v_t$ is less than $0.1 \times v_y$, the winding angle becomes too small, and as a result, the end surface of the cheese may bulge out, in other words the shape of the cheese becomes inferior. On the other hand, if the traversing speed $v_t$ is higher than $0.3 \times v_y$, the modified false twisted textured yarn which is not being wound on a bobbin will be affected adversely by the reciprocative movement of the traverse guide. As a result, tension fluctuation is caused in the modified false twisted yarn which is then wound on a bobbin while it includes tension fluctuation therein, and the thus obtained soft wound cheese becomes inferior in the uniformity of the apparent density and in the wound shape.

According to a method for winding a false twisted yarn of the present invention, in other words according to the method which satisfies the above-mentioned equation (1), and not necessarily but desirably, together with the equation (2), a soft wound cheese which has a uniform apparent density and good shape can be formed easily. In the case wherein the equations (1) and (2) are simultaneously satisfied, the obtained soft wound cheese of the modified false twisted textured yarn is thermally stabilized. Accordingly, if the yarn is heat treated in the succeeding heat setting or dyeing operation, it is substantially not affected adversely by heat shrinkage due to the heat treatment. As a result, a heat treated cheese which has a uniform apparent density and a superior shape can be obtained.

Some examples of the present invention will be explained hereinbelow.

EXAMPLE 1

A highly orientated undrawn polyester yarn was subjected to a simultaneous draw texturing operation in a machine illustrated in FIG. 1 so that a modified false twisted textured yarn having a total denier of 150 denier and composed of 48 filaments was obtained, and then the obtained yarn was soft wound on a bobbin to form a cheese in accordance with the three conditions described in Table 1. As a comparison, the yarn delivery means 8 illustrated in FIG. 1 is replaced with a fixed yarn guide (not shown), and the yarn was wound on a bobbin in a conventional manner under the three conditions described in Table 1. In the Example 1 and the comparison, the traverse stroke was 250 mm, and the amount of the obtained cheese was 2 kg.

As will be apparent from Table 1, the straight cheeses obtained in accordance with the method of the present invention had an apparent density almost equal to or less than 0.15 g/cm$^3$ and substantially did not have bulges on its lateral end surfaces. As a result, the characteristics of the dyed yarn which is obtained by a cheese dyeing operation was superior because the crimp rigidity percentage (CR) was sometimes 15 or 16%. In addition, the difference in the crimp rigidity percentage (CR) and dyeability between the locations in the cheese was very small, in other words, a cheese dyed yarn which was uniform in the crimp characteristic and dyeability was obtained.

EXAMPLE 2

A highly orientated undrawn polyester yarn was subjected to a simultaneous draw texturing operation in a machine illustrated in FIG. 4 under four different conditions which satisfy the equation (2) so that an modified false twisted textured yarn having a total denier of 150 denier composed of 48 filaments was soft wound on a bobbin in the machine. The traverse stroke was 250 mm, and the amount of the cheese was 2 kg. The conditions and the characteristics of the obtained yarn are described in Table 2.

As will be apparent from Table 2, according to the method for winding a false twisted yarn into a cheese of the present invention, a straight cheese having an apparent density equal to or less than 0.3 g/cm$^3$ and substantially not having bulges at the lateral end surfaces thereof could be formed.

It was confirmed that the dyed yarn obtained by rewinding the cheese into a cone through a dyeing operation of the cheese was uniform in the crimp rigidity percentage (CR), and shade (L value) between the locations in the cheese. Note that in almost all the conventional cheese dyed yarn which is industrially manufactured and commercially available, the difference in the crimp rigidity percentage (CR) between the locations in the cheese is at least 3%.

Note: In Tables 1 and 2, the crimp rigidity percentage (CR) was measured in accordance with the stipulation of the Japanese Industrial Standard (JIS) No. L-1077; the L value was measured by means of a Digital Color Difference Meter, type AUD-SCH2 manufactured by Suga Shikenki Kabushiki Kaisha, Japan, after the yarn formed in cheese was dyed and was knitted by a circular knitting machine; and the Y value was calculated by the equation $Y=L^2/100$.

lized by being subjected to a heat treatment in a second heat treatment region at a second feed ration Mf % of between 5% and the shrinking limit of said yarn, and which is delivered at a speed of V cm/sec from a false twisting region, wherein false twists imparted into a fed

TABLE 1

| | | | Examples | | | Comparisons | | |
|---|---|---|---|---|---|---|---|---|
| False Twisting Conditions | Peripheral Speed of 1st Rollers | m/min | 225 | | | | | |
| | Peripheral Speed of 2nd Rollers | m/min | 400 | | | | | |
| | Temperature of 1st Heater | °C. | 215 | | | | | |
| | Temperature of 2nd Heater | °C. | 215 | | | | | |
| | False Twisting Apparatus | | Outer friction (3 shafts with friction disks) | | | | | |
| | Peripheral Speed of 3rd Rollers | m/min | 368 | 344 | 320 | 368 | 344 | 320 |
| | Peripheral Speed of Delivery Means | m/min | 368 | 344 | 320 | | Fixed Guide | |
| | " | cm/sec | 613 | 573 | 533 | | | |
| | Winding Speed | m/min | 354 | 333 | 312 | 354 | 333 | 312 |
| | Time Period S | sec | 0.057 | 0.061 | 0.066 | 0.326 | 0.349 | 0.375 |
| | Lower Limit 15/V | sec | 0.0245 | 0.0262 | 0.0281 | 0.0245 | 0.0262 | 0.0281 |
| | Upper Limit $\frac{5}{6} \times 10^5/V^2$ | sec | 0.222 | 0.254 | 0.293 | 0.222 | 0.254 | 0.293 |
| Cheese Characteristics | Apparent Density | $g/cm^3$ | 0.152 | 0.131 | 0.118 | 0.310 | 0.251 | * |
| | Bulge of End Surfaces (i.e., Difference between Maximum Wound Width and Transverse Stroke) | mm | 10 | 12 | 15 | 35 | 40 | * |
| Dyed Yarn Characteristics | Crimp Rigidity Percentage (CR) % | Innermost Portion | 7.8 | 11.5 | 16.7 | 4.5 | 4.8 | * |
| | | Intermediate Portion | 6.5 | 10.1 | 15.4 | 3.2 | 3.6 | * |
| | | Outermost Portion | 6.0 | 9.5 | 14.8 | 2.0 | 2.3 | * |
| | Colour Difference (Y value) | Innermost Portion | 6.19 | 5.89 | 5.79 | 6.20 | 6.20 | * |
| | | Intermediate Portion | 6.41 | 5.92 | 5.89 | 6.52 | 6.48 | * |
| | | Outermost Portion | 6.47 | 6.12 | 6.03 | 6.78 | 6.72 | * |

*It was impossible to form a cheese because of the yarn slack

TABLE 2

| | | | | | | |
|---|---|---|---|---|---|---|
| False Twisting Conditions | Peripheral Speed of 1st Rollers | m/min | 225 | | | |
| | Peripheral speed of 2nd Rollers | m/min | 400 | | | |
| | Temperature of 1st Heater | °C. | 215 | | | |
| | Temperature of 2nd Heater | °C. | 215 | | | |
| | False Twisting Apparatus | | Outer Friction (3 shafts with friction disks) | | | |
| | Peripheral Speed of 3rd Rollers | m/min | 360 | 344 | 328 | 312 |
| | " | cm/sec | 600 | 573 | 547 | 520 |
| | Peripheral Speed of Drive Roller | m/min | 352 | 336 | 320 | 304 |
| | Traverse Speed | m/min | 80 | | | |
| | Contacting Pressure | upon commencement | 1.5 kg | | | |
| | | upon completion | 3.0 kg | | | |
| | Second Feed Ratio | % | +10 | +14 | +18 | +22 |
| | Winding Feed Ratio | % | +12 | +16 | +20 | +24 |
| | Time Period S | sec | 0.083 | 0.087 | 0.091 | 0.096 |
| Cheese Characteristics | Apparent Density | $g/cm^3$ | 0.130 | 0.129 | 0.120 | 0.116 |
| | Bulge of End Surfaces (i.e., Difference Between Maximum Wound Width and Traverse Stroke) | mm | 13 | 12 | 10 | 10 |
| Dyed Yarn Characteristics | Crimp Rigidity Percentage (CR) % | Innermost Portion | 9.0 | 11.5 | 15.0 | 18.5 |
| | | Intermediate Portion | 8.4 | 10.7 | 14.0 | 16.8 |
| | | Outermost Portion | 7.5 | 9.9 | 13.2 | 16.5 |
| | Shade (L value) | Innermost Portion | 24.1 | 24.3 | 24.1 | 24.0 |
| | | Intermediate Portion | 24.5 | 24.3 | 24.4 | 24.2 |
| | | Outermost Portion | 24.7 | 24.7 | 24.5 | 24.5 |

What we claim is :

1. A method for cheese winding around a bobbin a false twisted yarn, crimps of which are thermally stabi- yarn running back therealong are heat set, by means of a yarn delivery means to said bobbin rotatably supported in a winding apparatus where said false twisted yarn is traversed to and fro along said bobbin to form a cheese thereon, characterized in that the time period S sec wherein said false twisted yarn travels from said yarn delivery means to said bobbin satisfies the following equation (1), $$\alpha/V \leqq S \leqq \beta/v2 \quad (1)$$

wherein:

$\alpha$ is 15, and $\beta$ is $5/6\times10^5$, whereby a soft wound straight cheese with an apparent density of at most 0.3 g/cm$^3$ is obtained.

2. A method for preparing a cheese of false twisted yarn comprising the steps of:

(1) false twist texturing a thermoplastic yarn in a heat treatment zone;

(2) conveying said yarn from said heat treatment zone at a speed of V cm/sec by a yarn delivery means to a bobbin rotatably supported in a winding apparatus and separated from said delivery means where said yarn travels from said delivery means to said bobbin in the time period S seconds with S defined as $$(\alpha/V) \leqq S \leqq (\beta/V^2)$$

wherein $\alpha$ is 15 and $\beta$ is $5/6\times10^5$; and (3) winding said yarn on said bobbin at a constant rate by a winding means by which said yarn is traversed to and fro along said bobbin to form a cheese with an apparent density of at most 0.3 g/cm$^3$.

3. A method for preparing a cheese of false twisted yarn comprising the steps of:

(1) false twist texturing a thermoplastic yarn in a first heat treatment zone;

(2) heating said yarn to stabilize said yarn in a second heat treatment zone wherein the feed ratio $M_f/\%$ is between about 5% and the shrinkage limit of said yarn;

(3) conveying said yarn from said second heat treatment zone at a speed of V cm/sec by a yarn delivery means to a bobbin rotatably supported in a winding apparatus and separated from said delivery means where said yarn travels from said delivery means to said bobbin in the time period S seconds with S defined as $$(\alpha/V) \leqq S \leqq (\beta/V^2)$$

wherein $\alpha$ is 15 and $\beta$ is $5/6\times10^5$; and (4) winding said yarn on said bobbin at a constant rate by a winding means by which said yarn is traversed to and fro along said bobbin to form a cheese with an apparent density of at most 0.3 g/cm$^3$.

4. A method according to claim 1, wherein said yarn is false twisted at a speed which is at least 300 m/min.

5. A method according to claim 1, wherein said rotatably supported bobbin is driven by a drive roller frictionally engaging therewith and a contacting pressure P kg between said bobbin and said drive roller at an initial stage of the winding operation satisfies the following equation (3).

$$0.3 \leqq P \leqq 5 \quad (3)$$

6. A method according to claim 1, wherein said yarn delivery means is located at a position which is identical with a fulcrum of the traverse motion in said winding apparatus.

7. A method according to claim 1 or 3, wherein said yarn is false twisted in said false twisting region at a speed of $v_y$ m/min, and the obtained false twisted yarn is overfed at said second feed ratio of $M_f\%$ in said second heat treating region which includes a second heater heated at a temperature T° C., and then said modified false twisted yarn is traversed to and fro at a traversing speed of $V_t$ m/min and wound on said bobbin at a winding feed ratio of $W_f\%$, characterized in that said winding feed ratio $W_f\%$ satisfies the following equation (2).

$$M_f + \left(\frac{T}{20} - 14\right) + \left(\frac{\sqrt{v_y^2 + v_t^2} - v_y}{v_y} \times 100\right) \leqq W_f \leqq M_f + \left(12 - \frac{T}{20}\right) + \left(\frac{\sqrt{v_y^2 + v_t^2} - v_y}{v_y} \times 100\right) \quad (2)$$

8. A method according to claim 7, wherein said yarn is false twisted at a speed which is at least 300 m/min.

9. A method according to claim 7, wherein said rotatably supported bobbin is driven by a drive roller frictionally engaging therewith and a contacting pressure P kg between said bobbin and said drive roller at an initial stage of the winding operation satisfies the following equation (3).

$$0.3 \leqq P \leqq 5 \quad (3)$$

10. A method according to claim 7, wherein said yarn delivery means is located at a position which is identical with a fulcrum of the traverse motion in said winding apparatus.

11. A method according to claim 2, wherein said yarn is false twisted at a speed which is at least 300 m/min.

12. A method according to claim 3, wherein said yarn is false twisted at a speed which is at least 300 m/min.

13. A method according to claim 2, wherein said rotatably supported bobbin is driven by a drive roller frictionally engaging therewith and a contacting pressure P kg between said bobbin and said drive roller at an initial stage of the winding operation satisfies the following equation (3).

$$0.3 \leqq P \leqq 5 \quad (3)$$

14. A method according to claim 3, wherein said rotatably supported bobbin is driven by a drive roller frictionally engaging therewith and a contacting pressure P kg between said bobbin and said drive roller at an initial stage of the winding operation satisfies the following equation (3).

$$0.3 \leqq P \leqq 5 \quad (3)$$

15. A method according to claim 2, wherein said yarn delivery means is located at a position which is identical with a fulcrum of the traverse motion in said winding apparatus.

16. A method according to claim 3, wherein said yarn delivery means is located at a position which is identical with a fulcrum of the traverse motion in said winding apparatus.

* * * * *

UNITED STATES PATENT AND TRADEMARK OFFICE

CERTIFICATE OF CORRECTION

PATENT NO. : 4,300,345

DATED : Nov. 17, 1981

INVENTOR(S) : Isamu Kasai; Kazuo Tomiita; and Hisao Inuyama

It is certified that error appears in the above—identified patent and that said Letters Patent is hereby corrected as shown below:

Col. 4, line 23, delete "words" and substitute --cases--.

Col. 6, line 28, delete "and" and substitute --are--.

Signed and Sealed this

*Eleventh* Day of *May 1982*

[SEAL]

*Attest:*

GERALD J. MOSSINGHOFF

*Attesting Officer*

*Commissioner of Patents and Trademarks*